US005406782A

United States Patent [19]

Inuyama et al.

[11] Patent Number: 5,406,782

[45] Date of Patent: Apr. 18, 1995

[54] DRAWING FALSE-TWISTING METHOD AND A DRAWING FALSE-TWISTER

[75] Inventors: Hisao Inuyama; Masaru Kimura, both of Ohtsu; Osamu Hirao, Uji, all of Japan

[73] Assignee: Murata Kikai Kabushiki Kaisha, Kyoto, Japan

[21] Appl. No.: 34,141

[22] Filed: Mar. 22, 1993

[30] Foreign Application Priority Data

Mar. 23, 1992 [JP] Japan ..... 4-097252

[51] Int. Cl.[6] ..... D01H 7/92; D01H 13/04

[52] U.S. Cl. ..... 57/284; 57/352

[58] Field of Search ..... 57/282, 283, 284, 285, 57/286, 287, 289, 290, 291, 292, 352

[56] References Cited

U.S. PATENT DOCUMENTS 3,368,335 2/1968 Horvath ..... 57/284
3,774,388 11/1973 Berger ..... 57/285
4,010,601 3/1977 Anahara et al. ..... 57/283 X

FOREIGN PATENT DOCUMENTS 27137 2/1991 Japan ..... 57/283

*Primary Examiner*—Joseph J. Hail, III
*Attorney, Agent, or Firm*—Spensley Horn Jubas & Lubitz

[57] ABSTRACT

In a drawing false-twisting method, which draws a twisted yarn, heat-sets the drawn and twisted yarn, cools the yarn by making the yarn travel in contact with the surface of the guide groove of a cooling plate and untwists the yarn to obtain a textured bulk yarn, the yarn is moved laterally to spread the oil transferred from the yarn to the surface of the guide groove.

2 Claims, 7 Drawing Sheets

DRAWING FALSE-TWISTING METHOD AND A DRAWING FALSE-TWISTER

BACKGROUND OF THE INVENTION

1. Field of the Invention

The present invention relates to a drawing false-twisting method capable of producing a textured bulk yarn through the continuous series of processes of twisting a yarn, heat-setting the twisted yarn and untwisting the heat-set yarn, and a drawing false-twister for carrying out the drawing false-twisting method. More particularly, the present invention relates to a drawing false-twisting method and a drawing false-twister capable of reducing irregularities in the crimps of the textured bulk yarn to prevent irregularities, such as thin bands, in a woven fabric.

2. Related Art Statement

The construction of a drawing false-twister for carrying out a drawing false-twisting method will be described with reference to FIG. 7 showing one of the drawing false-twisting units of the drawing false-twister for drawing and false-twisting polyester multifilament yarns or nylon multifilament yarns, which, in general, are called POYs (partially oriented yarns). A multifilament yarn 2 unwound from a yarn package 1 is guided by guides 3, 4 and 5 to a first feed roller 6. Then the yarn 2 fed upward into a primary heater 7 disposed in an upright position by the feed roller 6 reaches a guide 8 disposed above the primary heater 7. Since the primary heater 7 is relatively tall, the yarn 2 travels obliquely downward over a service passage 19 from the guide 8 toward a guide 11. The yarn is cooled by a cooling plate 9 disposed between the guide 8 and 11 and is false-twisted by a belt-type false-twisting device 10. The false-twisted yarn is guided by the guide 11 to a second feed roller 12. The respective surface speeds of the first feed roller 6 and the second feed roller 12 are determined so that the surface speed ratio between the first feed roller 6 and the second feed roller 12 is equal to a predetermined draw ratio. A portion of the yarn extending before the false-twisting device 10 is twisted and a portion of the yarn extending behind the false-twisting device 10 is untwisted. The twisted portion of the yarn is drawn at the predetermined draw ratio and is heat-set by the primary heater 7. Then, the yarn is overfed into a secondary heater 13 by the second feed roller 12 and is guided by a guide 14 to a third feed roller 15. Then, the drawn false-twisted yarn travels via guides 16 and 17 and is wound in a package 18 by a winder. The secondary heater 13 heat-sets the crimps of the overfed drawn false-twisted yarn to reduce the torque of the drawn false-twisted yarn and to retain the bulkiness of the same. The secondary heater 13 is not used if the desired characteristics of the drawn false-twisted yarn do not need secondary heating.

Thus, the drawing false-twisting method draws twisted yarn, heat-sets the drawn false-twisted yarn, cools the drawn false-twisted yarn and untwists the drawn false-twisted yarn to obtain the textured bulk yarn by the series arrangement of the first feed roller 6, the primary heater 7, the cooling plate 9, the false-twisting device 10 and the second feed roller 12 arranged in that order in the direction of travel of the yarn. The drawn false-twisted yarn is cooled by the cooling plate 9 for the following purposes. The yarn Y is heated at a high temperature of 160° C. or above by the primary heater 7. If the yarn Y heated at such a high temperature is twisted by the false-twisting device 10, the false-twisting device 10 is unable to twist the yarn Y stably and the twisting belts of the false-twisting device 10 may be affected by heat. Therefore, the yarn Y is cooled to a low temperature of 70° C. or below by the cooling plate 9 disposed between the primary heater 7 and the false-twisting device 10.

A prior art cooling plate 9 will be described hereinafter with reference to FIGS. 8 and 9. The cooling plate 9 is formed by bending a stainless steel strip in a shape having a V-shaped cross section and a guide groove 20 is formed in the bottom surface of the cooling plate 9. While the yarn Y travels in contact with the surface of the guide groove 20, the yarn Y is cooled mainly through heat exchange between the yarn Y and the cooling plate 9. Since twists inserted in the yarn Y by the false-twisting device 10 propagate, the yarn Y tends to roll in the direction of the twists. For example, the yarn Y tends to roll in the direction of the arrow j (FIG. 9) if Z-twists are inserted in the yarn Y. Therefore, the guide groove 20 is formed in a curved sectional shape so that the rolling force of the yarn Y and the force biasing the yarn Y toward the bottom of the guide groove 20, balance each other. To cope with switching in Z-twist or S-twist, the curved sectional shape is symmetrical, and is generally the guide groove 20 having a curved surface of radius r. The cooling plate 9 is curved in the shape of an arc of a circle having a radius R and ensures the satisfactory contact of the yarn Y with the surface of the guide groove 20. The heat transferred from the yarn Y to the cooling plate 9 is radiated naturally from the outer surface 21 of the cooling plate 9. Therefore, temperature distribution in the cooling plate 9 declines at a gentle gradient from the inlet portion of the cooling plate of a comparatively high temperature toward the outlet portion of the same of a comparatively low temperature.

It is known that periodically light filling bars form in a fabric when the fabric is woven by using dyed yarns produced by dyeing textured bulk yarns produced by drawing and false-twisting specific POYs, namely, POYs having a high oil content, by the prior art drawing false-twister. It was found that these light filling bars are attributable to dyeing irregularities, and dyeing irregularities are attributable to the irregular crimps of the drawn false-twisted yarns. It was also found that the period of variation of irregular crimps coincides with the period of appearance of peaks of tension during untwisting at a point A on the drawing false-twister of FIG. 7.

SUMMARY OF THE INVENTION

The present invention has been made through efforts to identify the causes of peaks of tension during untwisting at a period coinciding with the period of variation of irregular crimps and it is therefore an object of the present invention to provide a drawing false-twisting method capable of eliminating irregularities in crimps of drawn false-twisted yarns so that light filling bars may not be formed in a fabric woven by using the drawn false-twisted yarns and to provide a drawing false-twister for carrying out the drawing false-twisting method.

To achieve the object, the present invention provides a drawing false-twisting method comprising steps of: drawing a twisted yarn; heat-setting the twisted and drawn yarn; passing the heat-set yarn along the guide groove of a cooling plate to cool the heat-set yarn by contact cooling; and untwisting the cooled yarn to obtain a textured bulk yarn; characterized in that the heat-set yarn is staggered in the guide groove to disperse the oil transferred from the heat-set yarn to the surface of the guide groove over the surface of the guide groove.

The present invention provides also a drawing false-twister comprising: a pair of feed roller; a heating unit disposed between the pair of feed rollers; a false-twisting device disposed between the pair of feed rollers; and a cooling plate having a guide groove and disposed between the heating unit and the false-twisting device; the improvement comprising a yarn moving means combined with the cooling plate to move the yarn laterally in the guide groove.

Efforts had been made to identify the causes of peaks of tension which appear periodically during unwinding through the analysis of certain factors and it was found that the movement of the yarn on the cooling plate was related to the periodic appearance of peaks of tension during unwinding. As shown in FIG. 10*a*, when a yarn Y travels stably via a specific point in the guide groove 20 of a cooling plate 9, oil 22 transferred from the yarn Y to the cooling plate 9 accumulates gradually around the specific point in the guide groove 20. After the oil 22 has accumulated to an extent that the yarn Y travels through the accumulated oil 22, the propagation of twists along the yarn Y is impeded by the accumulated oil 22 and the effect of the oil 22 on the impediment of the propagation of twists increases with the increase of the accumulated oil 22. Upon the increase of the quantity of the accumulated oil 22 to a limit quantity, the accumulated oil 22 is scattered suddenly in mists 23 23 by the increased torque of the yarn Y as shown in FIG. 10*b*. Thus, it was found that the abnormally accumulated twists accumulated in the yarn in a period between the impediment of the propagation of twists by the accumulated oil 22 and the sudden scattering of the accumulated oil cause irregular crimps. It was found also that the oil accumulated on the cooling plate is brought to the false-twisting device by the yarn and causes the twisting action of the false-twisting device to vary instantaneously and such an instantaneous variation of the twisting action of the false-twisting device causes irregular twists. When the yarn Y is moved laterally in the directions of the arrows a and b in the guide groove 20 as shown in FIG. 1, the oil adhering to the surface of the guide groove 20 is scattered or shoved to areas c where the accumulated oil will not be caught by the yarn Y by the moving twisted yarn Y. Thus, the oil is dispersed over the surface of the guide groove instead of being locally accumulated as shown in FIG. 10*a* and, consequently, irregularities of crimps caused by irregular twists attributable to the periodic impediment of the propagation of twists by the locally accumulated oil can be prevented.

A drawing false-twister employs a moving means for forcibly moving the yarn laterally along the surface of the guide groove of the cooling plate in combination with the cooling plate to move the yarn laterally for the entire length of the cooling plate.

DETAILED DESCRIPTION OF PREFERRED EMBODIMENTS

Figure 1:
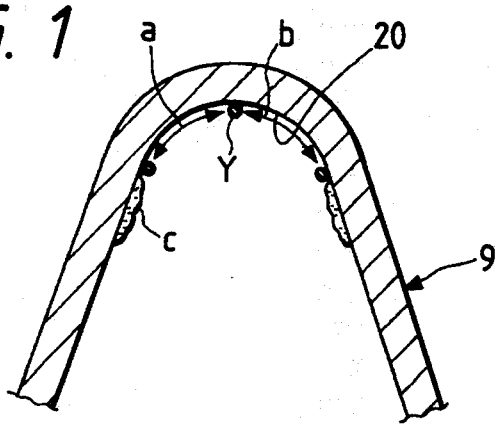
FIG. 1 is a sectional view for assisting in the explanation of a drawing false-twisting method according to the present invention.
Figure 8:
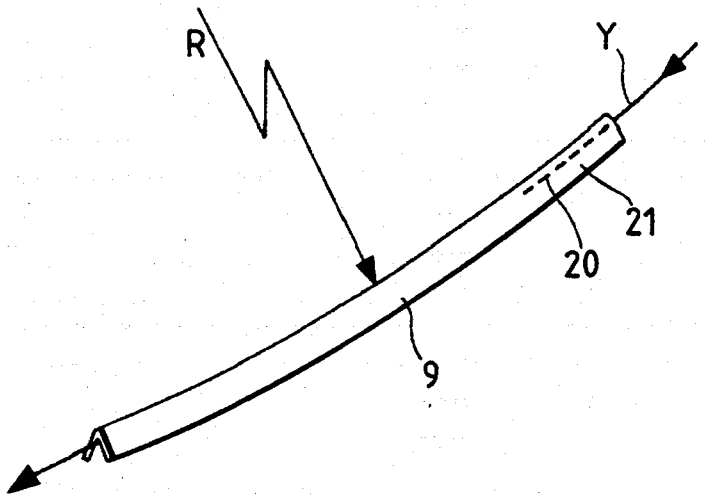
FIG. 8 is a perspective view of a cooling plate.
Figure 9:
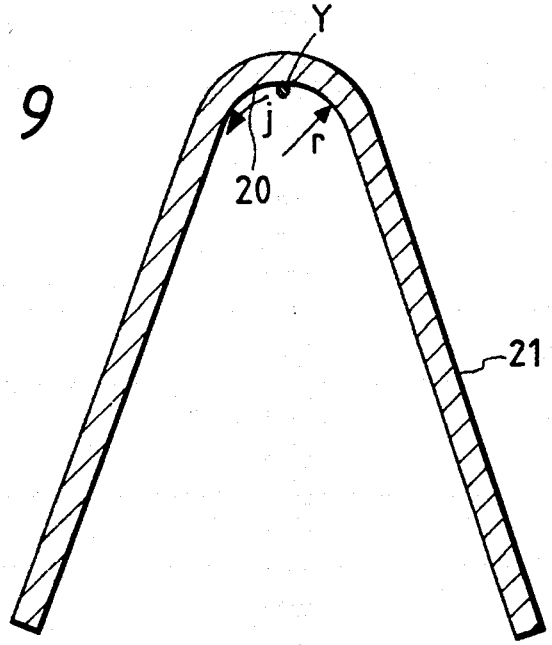
FIG. 9 is a sectional view of a cooling plate.
Figure 10A:
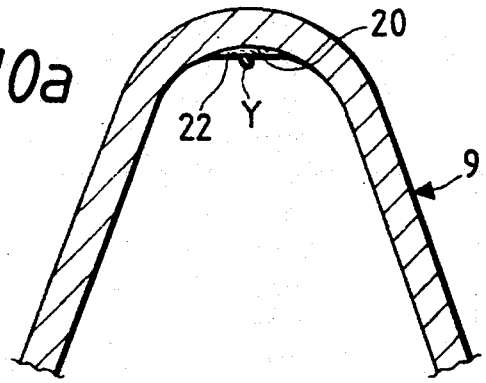
FIGS. 10*a* and 10*b* are views showing oil accumulated locally on the surface of a conventional cooling plate.
Figure 10B:
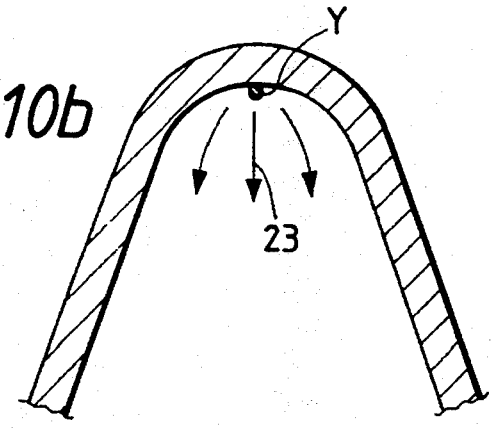

Preferred embodiments of the present invention will be described hereinafter with reference to the accompanying drawings. FIG. 1 is a fragmentary sectional view of the guide groove of a cooling plate, for illustrating a drawing false-twisting method in a preferred embodiment according to the present invention, and FIGS. 2*a* to 4*c* are views of the components of a drawing false-twister in a preferred embodiment according to the present invention. A cooling plate employed in the present invention is different in construction and function from the prior art cooling plate shown in FIGS. 8 and 9.

Figure 3A:
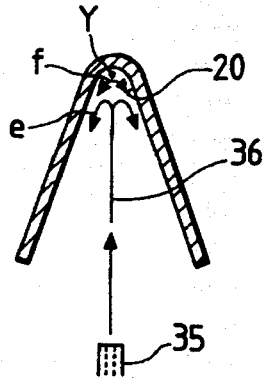
FIGS. 3*a* and 3*b* are views of essential components of a drawing false-twister according to the present invention.
Figure 3B:
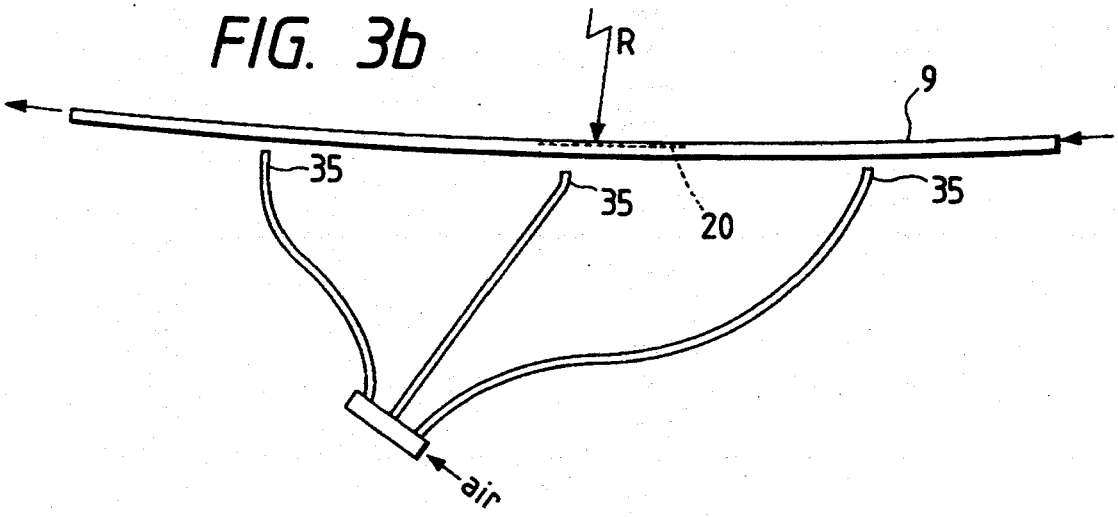
Figure 2B:
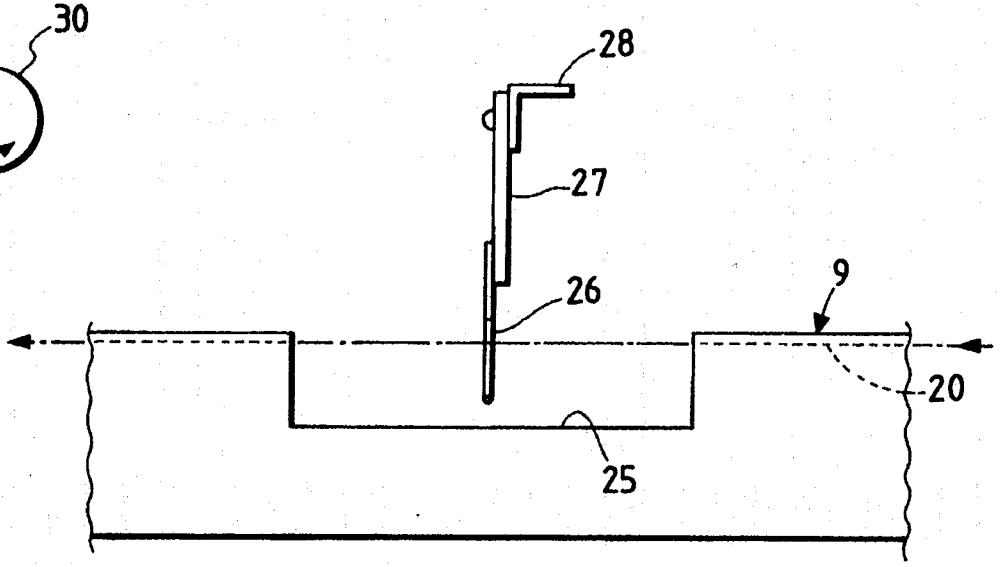
FIGS. 2*a*, 2*b* and 2*c* are views of essential components of a drawing false-twister according to the present invention.
Figure 2A:
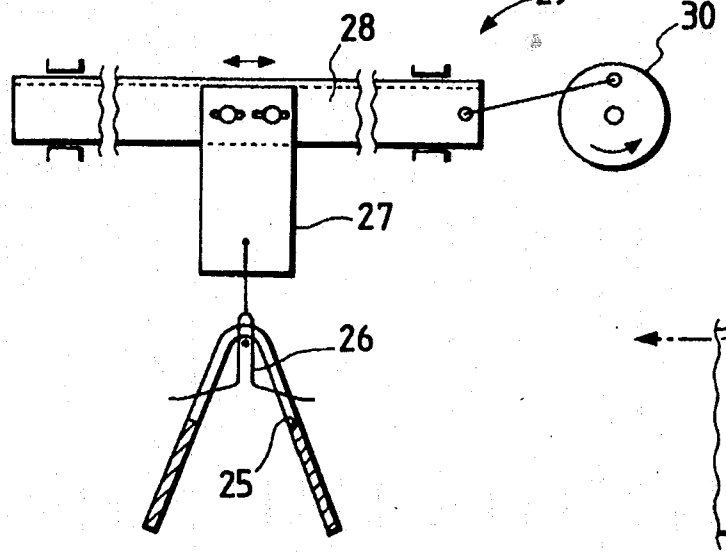
Figure 2C:
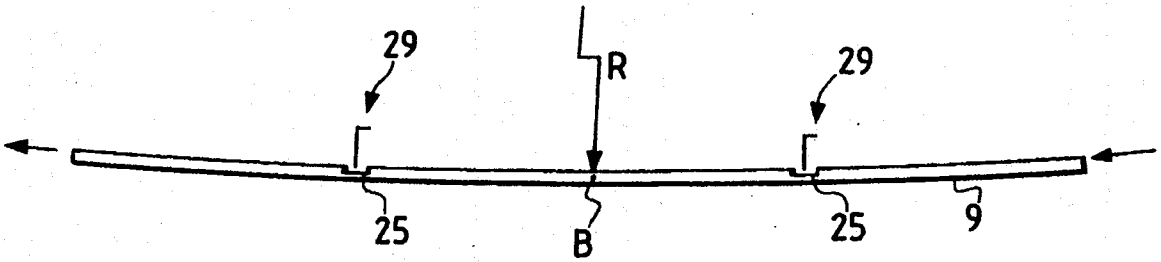
Figure 4B:
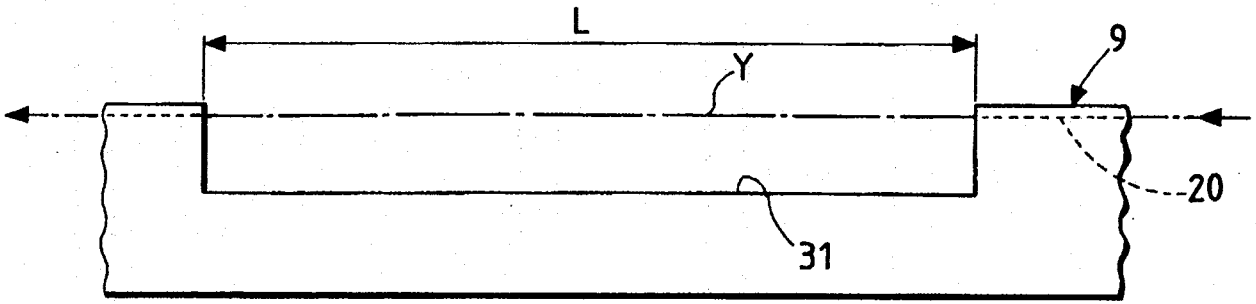
FIGS. 4*a*, 4*b* and 4*c* are views of essential components of a drawing false-twister according to the present invention.
Figure 4A:
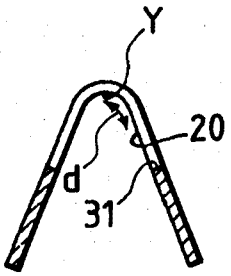
Figure 4C:
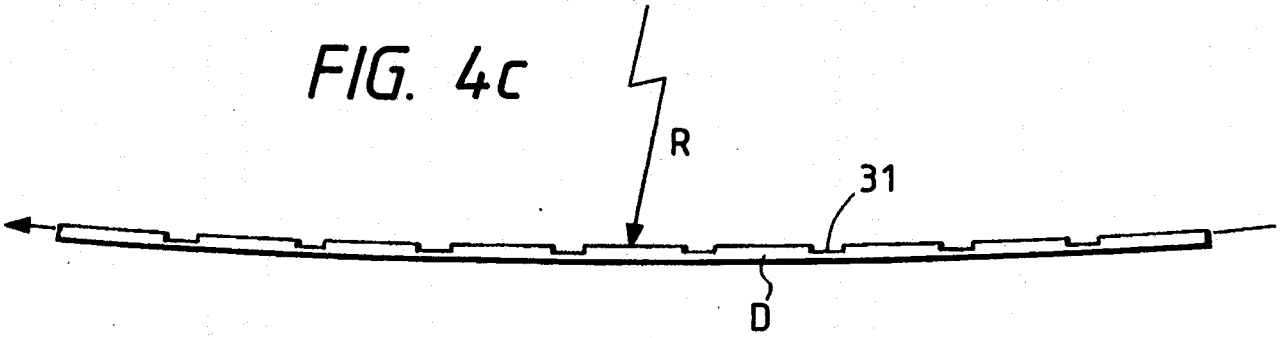

FIGS. 2*a* to 2*c* show a mechanical yarn moving device, FIGS. 3*a* and 3*b* show a pneumatic yarn moving device, and FIGS. 4*a* to 4*c* show a natural yarn moving device utilizing the propagation of twists along a yarn for moving the yarn. The effects of these yarn moving devices are remarkable when applied to drawing false-twisting a yarn having a relatively high oil content. The oil content of yarns, in general, is in the range of 0.35 to 0.4%. The yarn moving devices are effective when the oil content is on the order of 0.5%.

FIGS. 2*a* to 2*c* are a sectional view, a fragmentary side view and a general side view, respectively, of a cooling plate. As shown in FIG. 2*c* two openings 25 are formed at two positions of the guide groove 20 of a cooling plate 9, and two yarn moving devices 29 are disposed in connection with the openings 25, respectively. As shown in FIGS. 2*a* and 2*b*, each yarn moving device 29 comprises a reciprocating bar 28 driven for reciprocation by a driving device 30, a bracket 27 attached to the reciprocating bar 28, and a yarn guide 26 having a portion forming a U-shaped guide groove and a funnel-like portion, disposed at the middle of the opening 25 and attached to the bracket 27. The yarn guides 26 of a plurality of drawing false-twisting units are moved by the reciprocating bar 28. The yarn moving device 29 moves the yarn Y regularly along the curved face of the yarn guide groove 20 in the cross sectional direction thereof as shown in FIG. 1. The yarn moving devices 29 are disposed at an appropriate interval as shown in FIG. 2*c* so that the yarn Y can be moved laterally at the middle point B between the yarn moving devices 20. Consequently, the oil transferred from the yarn Y to the surface of the guide groove 20 is spread over the surface of the guide groove 20, whereby irregular crimps attributable to the localized accumulation of the oil in the guide groove 20 can be prevented. The yarn guides 26 of the yarn moving devices 29 need not necessarily be reciprocated continuously, the yarn guides 26 may be intermittently reciprocated.

FIG. 3*a* is a sectional view of a cooling plate and FIG. 3*b* is a general side view of the cooling plate. As shown in FIG. 3*a*, nozzles 35 are disposed with their outlet ends directed toward the bottom of the guide groove 20 of a cooling plate 9 to blow air currents 36 against the yarn Y traveling along the guide groove 20. Then, the air flows randomly in lateral directions indicated by the arrows e along the side surfaces of the guide groove 20 and in longitudinal directions along the bottom surface of the guide groove 20, causing the yarn Y to vibrate laterally in directions indicated by the arrows f. The vibrations are propagated by the air longitudinally flowing along the bottom surface of the guide groove 20. The nozzles 35 are arranged at appropriate intervals so that almost the entire length of the yarn Y is vibrated. Air currents 36 need not necessarily be blown out through the nozzles 35; the air currents 36 may be intermittently blown out through the nozzles 35.

FIGS. 4*a*, 4*b* and 4*c* are respectively, a sectional view, a fragmentary side view and a general side view, of a cooling plate. As shown in FIGS. 4*a* and 4*b*, notches 31 are formed in the guide groove 20 of the cooling plate 9 at intervals. The notches 31 are formed for a length L, long enough to allow the yarn Y to be freely placed within the notches and to move easily in the groove 20. Although twists propagating along the yarn Y causes the yarn Y to climb up the side surface of the groove 20, the yarn Y climbs halfway up the side surface of the guide groove 20 and slides down the side surface of the guide groove 20 because the side surface of the guide groove 20 is interrupted by the notches 31 and the yarn is freely placed therein, so that the yarn Y climbs up and down the side surface of the guide groove 20 repeatedly as indicated by the arrows d. When the notches 31 are formed at short intervals as shown in FIG. 4*c*, longitudinal reciprocating movement of the yarn Y occurs naturally without using an external force and the yarn Y reciprocates at points D between the notches 31.

The yarn Y is moved locally along the guide groove by the forced moving means shown in FIGS. 2 and 3. The mode of reciprocating movement of the yarn Y caused by the natural moving means shown in FIG. 4 is dependent on the shape of the guide groove. Accordingly, it is desirable that the shape of the guide groove of the cooling plate meets the following conditions to satisfactorily propagate the movement applied to the yarn along the guide groove or to facilitate the natural movement of the yarn. The roughness of the surface of the guide groove is particularly important. Although the surface roughness of the guide groove, in general, is in the range of 2.2 to 1.5 S, it is preferable to form the guide groove having a surface roughness of 1.0 S or below, to enable the yarn to slip easily. The yarn is pressed against the guide groove by a great force if the radius R of curvature of the cooling plate is smaller. Although the radius of curvature of ordinary cooling plate is in the order of 20 m, it is preferable that the radius R of curvature of the cooling plate of the present invention is 30 m or above. If the radius r of curvature of the bottom surface of the guide groove is excessively small, the yarn is unable to move properly. Therefore, it is preferable that the radius r of curvature of the bottom surface of the guide groove is 2 mm or above.

Figure 5A:
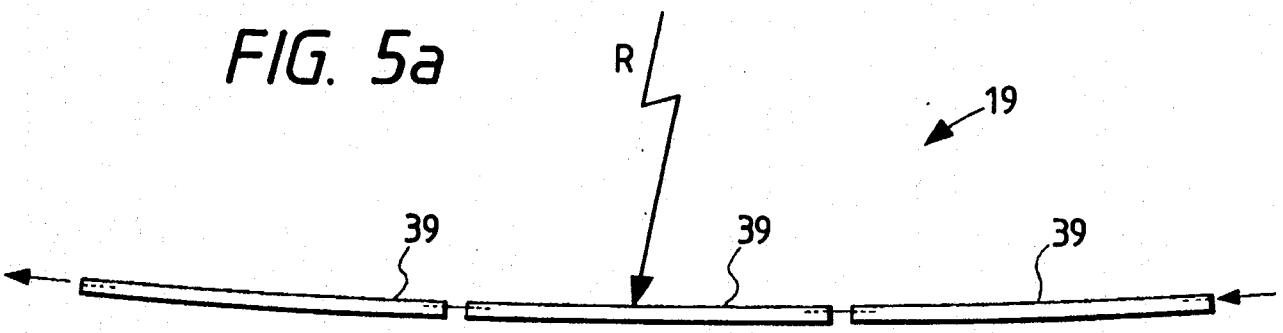
FIGS. 5*a* and 5*b* are views of another cooling plate.
Figure 5B:
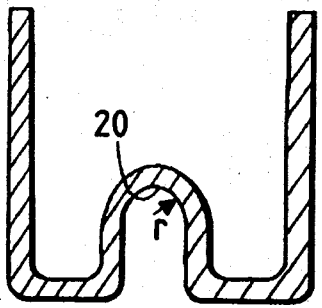

The cooling plate need not necessarily be of a single piece. A cooling plate 19 of a predetermined length consisting of a plurality of short cooling plates 39 as shown in FIG. 5*a* may be employed. The cooling plate 39 need not necessarily be formed in a V-shaped cross section; the cooling plate 39 may be formed in a U-shaped cross section as shown in FIG. 5*b*. Essentially, the bottom surface of the guide groove 20 of the cooling plate is formed in a predetermined curved surface. The cross section of the bottom surface may be either an arc of a circle of a radius r or a portion of an ellipse.

Effects of the present invention will be described in concrete terms, using the results of drawing false-twisting experiments. Common conditions for the drawing false-twisting experiments are as follows.

Yarn: 270 denier POY (Oil content: 0.5%)
Processing speed: 913 m/min
Draw ratio: 1.777
Processing temperature of the primary heater: 230° C.

In an example 1 according to the present invention, a cooling plate having a guide groove with a surface roughness of 1.0 S and a bottom surface having a radius of curvature of 2 mm and radius of curvature of 30 m, and provided with two recesses was used. The yarn moving device of FIG. 2 was disposed at each recess, and the yarn was moved by the yarn moving devices at a rate of 3 mm/sec.

In an example 2 according to the present invention, a cooling plate having a guide groove with a surface roughness of 1.0 S and a bottom surface having a radius of curvature of 2 mm and radius of curvature of 30 m, and provided with two recesses was used. The nozzle of FIG. 3 was disposed at each recess to blow an air current to the yarn. The experimental results of the examples 1 and 2 are shown in FIGS. 6*a*.

In an example 3 according to the present invention, a cooling plate having a guide groove having a surface roughness of 1.0 S and a bottom surface having a radius of curvature of 2 mm, having a radius of curvature of 30 m, and provided with three 100 mm long cuts as shown in FIG. 4 (the cooling plate shown in FIG. 4 is provided with eight cuts) was used. The experimental result of the example 3 is shown in FIG. 6*b*.

In a comparative example 1, a cooling plate having a guide groove with a surface roughness of 2.2 S and a bottom surface having a radius of curvature of 2 mm and radius of curvature of 20 m was used. The result of the comparative example 1 is shown in FIG. 6*c*.

Figure 6A:
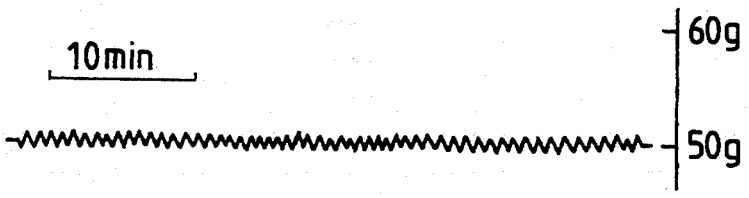
FIGS. 6*a*, 6*b* and 6*c* are graphs showing the variation of untwisting tension.
Figure 6B:
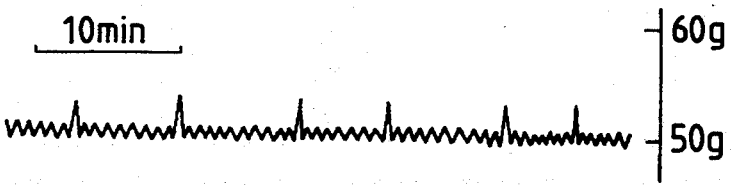
Figure 6C:
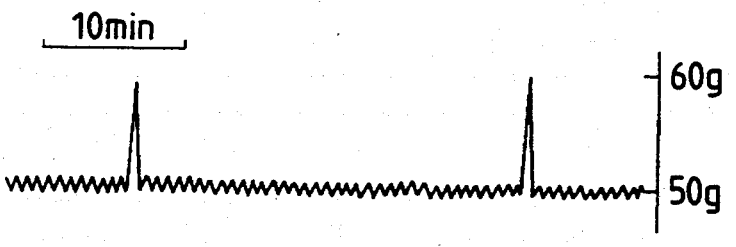

FIGS. 6*a*, 6*b* and 6*c* are graphs showing the variation of untwisting tension in the examples 1, 2 and 3 and the comparative example 1. As is evident from FIG. 6*c* showing the variation of untwisting tension in the comparative example 1, peaks greater than the average tension by 20% or above appeared periodically due to the oil accumulated on the cooling plate, and filling bands attributable to irregular crimping appeared in a fabric woven by using the false-twisted yarn. As shown in FIG. 6*a*, no peak appeared at all in the untwisting tension in the examples 1 and 2, and no irregular crimps were formed. As shown in FIG. 6*b*, in the example 3 of the present invention using natural yarn moving means, although peaks in the range of 6 to 7% appeared in the untwisting tension, the irregularity of crimps was not significant enough to completely eradicate the formation of filling bands in a fabric woven by using the false-twisted yarns.

Figure 7:
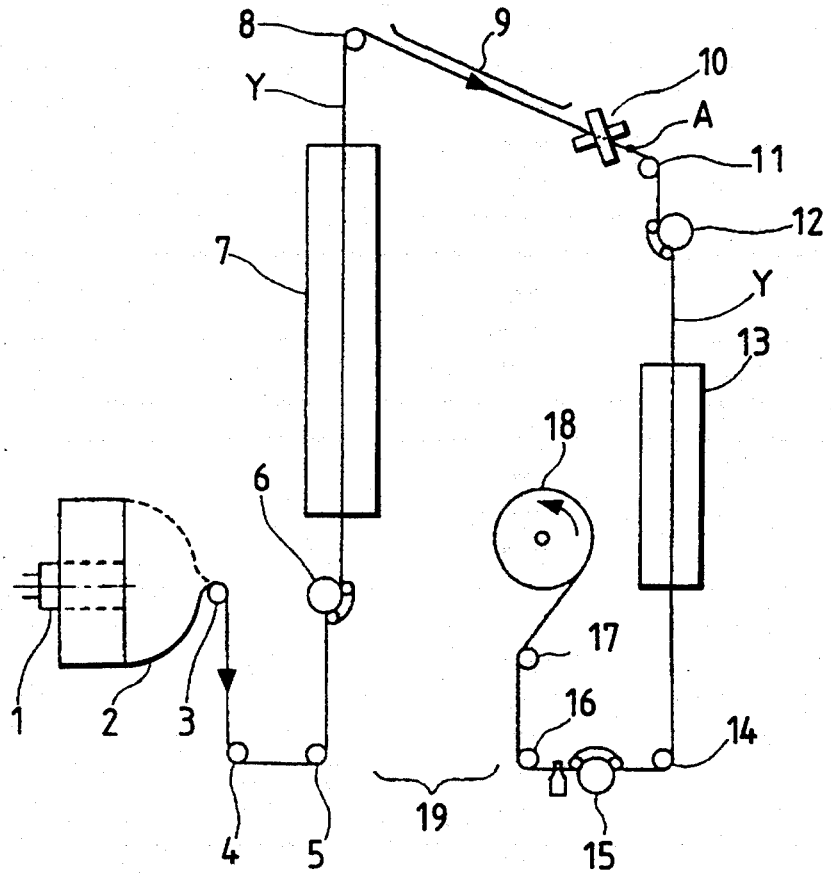
FIG. 7 is a diagrammatic view of a drawing false-twister.

The application of the drawing false-twisting method of the present invention is not limited to the drawing false-twisted of an arrangement shown in FIG. 7. For example, the drawing false-twisting method of the present invention is applicable to a drawing false-twister provided with a primary heater and a cooling plate disposed in a straight arrangement or to a drawing false-twister provided with a disk-type false twisting device instead of the belt-type false twisting device.

The drawing false-twisting method of the present invention moves the yarn along the curved face of the yarn guide groove 20 in the cross sectional direction thereof to spread the oil transferred from the yarn to the surface of the guide groove over the surface of the guide groove, so that the oil is scattered by the yarn along which twists propagate, or shoved to areas where the oil is not caught by the yarn. Thus, the propagation of twists along the yarn will not be impeded by the accumulated oil and hence irregular crimps are reduced and filling bands will not be formed in a fabric woven by using yarn produced by the drawing false-twisting method of the present invention.

The drawing false-twister of the present invention is provided with forced yarn moving means in combination with a cooling plate to move the yarn forcibly in lateral directions over the entire length of the guide groove. Thus, the oil will not be accumulated locally in the guide groove and the propagation of twists along the yarn in the entire length of the guide groove is not impeded.

In the embodiment mentioned above, the cooling plate is fixed and the yarn is positively moved. However, the cooling plate may be moved without positively moving the yarn.

What is claimed is:

1. A drawing false-twister comprising:

a heating unit disposed between a pair of feed rollers, a cooling plate disposed between the heating unit and a false-twisting device, the cooling plate having a guide groove, the guide groove having a surface, and yarn moving means for imparting movement to the heat-set yarn in a lateral direction relative to the guide groove sufficient to disperse oil adhering to the surface of the guide groove to areas of the guide groove spaced from the yarn, the yarn moving means comprising:

at least one opening formed in the guide plate along the guide groove, the at least one opening defining a middle, and at least one yarn moving device disposed substantially adjacent the at least one opening, the at least one yarn moving device comprising:

a reciprocating bar, a driving device for driving the reciprocating bar, a bracket attached to the reciprocating bar, and a yarn guide attached to the bracket and disposed substantially at the middle of the at least one opening, the yarn guide having a portion forming a U-shaped guide groove and a funnel-like portion.

2. The drawing false-twister of claim 1, wherein the yarn moving means is provided on the cooling plate.

* * * * *